US012000148B2

(12) United States Patent
Sorkin

(10) Patent No.: US 12,000,148 B2
(45) **Date of Patent: *Jun. 4, 2024**

(54) MULTI-ANCHOR CONCRETE POST-TENSIONING SYSTEM

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/968,240

(22) Filed: Oct. 18, 2022

(65) Prior Publication Data

US 2023/0040105 A1 Feb. 9, 2023

Related U.S. Application Data

(62) Division of application No. 16/822,733, filed on Mar. 18, 2020, now Pat. No. 11,473,303.

(60) Provisional application No. 62/821,978, filed on Mar. 21, 2019.

(51) Int. Cl.
*E04C 5/12* (2006.01)
*E04C 5/16* (2006.01)
*E04C 5/20* (2006.01)

(52) U.S. Cl.
CPC ..... *E04C 5/122* (2013.01); *E04C 5/162* (2013.01); *E04C 5/203* (2013.01)

(58) Field of Classification Search
CPC ..... E04C 5/122; E04C 5/125; E04C 5/162; E04C 5/203
USPC ..... 52/223.13
See application file for complete search history.

(56) References Cited

U.S. PATENT DOCUMENTS 3,605,361 A * 9/1971 Howlett et al. ..... E04C 5/122 52/223.13
3,658,296 A * 4/1972 Yegge ..... E04C 5/122 52/223.13
3,843,288 A * 10/1974 Howlett ..... B28B 23/043 52/223.13
4,023,242 A * 5/1977 Caro Roqueta ..... E04C 5/12 403/368
4,773,198 A * 9/1988 Reinhardt ..... E04C 5/122 52/223.13

(Continued)

OTHER PUBLICATIONS

Communication pursuant to Article 94(3) EPC dated Dec. 20, 2022 issued in EP 20164239.4.

*Primary Examiner* — James M Ference
(74) *Attorney, Agent, or Firm* — Hunton Andrews Kurth LLP

(57) ABSTRACT

A system for use with a post-tensioning concrete anchor may comprise a connector anchor including a bore therethrough, the bore including a first frustoconical portion, the connector anchor adapted to bear on the post-tensioning concrete anchor, and a coupler. The coupler may comprise a coupler body including a bore therethrough, the bore including a second frustoconical portion that is oriented oppositely to the first frustoconical portion, and a connector having a bore therethrough and configured to receive the coupler body therein, the connector adapted to mechanically engage the connector anchor such that a tensioning force can be transmitted from the coupler body to the connector anchor via the connector. A method of using the system may allow a second concrete section to be poured adjacent to a first concrete section before the first concrete section has been stressed.

10 Claims, 4 Drawing Sheets

(56) References Cited

U.S. PATENT DOCUMENTS 4,799,307 A * 1/1989 Reigstad ..... E04C 5/122 52/223.13
4,896,470 A * 1/1990 Sorkin ..... B29C 45/14 52/223.13
5,055,021 A * 10/1991 Bonato ..... B28B 21/60 52/223.13
5,072,558 A * 12/1991 Sorkin ..... E04C 5/12 52/223.13
5,440,842 A * 8/1995 Sorkin ..... E04C 5/12 52/223.13
5,701,707 A * 12/1997 Sorkin ..... E04C 5/12 52/223.13
5,720,139 A * 2/1998 Sorkin ..... E04C 5/122 52/223.13
5,749,185 A * 5/1998 Sorkin ..... E04C 5/12 52/223.13
5,755,065 A * 5/1998 Sorkin ..... E04C 5/12 52/223.13
5,770,286 A * 6/1998 Sorkin ..... E04C 5/12 52/223.13
5,788,398 A * 8/1998 Sorkin ..... E04C 5/12 52/223.13
5,839,235 A * 11/1998 Sorkin ..... E04C 5/10 52/223.13
5,897,102 A * 4/1999 Sorkin ..... E04C 5/12 52/223.13
6,012,867 A * 1/2000 Sorkin ..... E01D 19/14 52/223.13
6,017,165 A * 1/2000 Sorkin ..... E04C 5/122 403/374.1
6,023,894 A * 2/2000 Sorkin ..... E04C 5/122 249/43
6,027,278 A * 2/2000 Sorkin ..... E04C 5/122 403/374.1
6,098,356 A * 8/2000 Sorkin ..... E04C 5/12 52/223.13
6,151,850 A * 11/2000 Sorkin ..... E04C 5/122 52/223.13
6,176,051 B1 * 1/2001 Sorkin ..... E04C 5/08 403/374.1
6,234,709 B1 * 5/2001 Sorkin ..... E04C 5/122 403/374.1
6,381,912 B1 * 5/2002 Sorkin ..... E04C 5/122 52/223.13
6,393,781 B1 * 5/2002 Sorkin ..... E04C 5/122 52/223.13
6,513,287 B1 * 2/2003 Sorkin ..... E04C 5/122 403/374.1
6,560,939 B2 * 5/2003 Sorkin ..... E04C 5/12 52/223.13
6,631,596 B1 * 10/2003 Sorkin ..... E04C 5/12 403/374.1
6,761,002 B1 * 7/2004 Sorkin ..... E04C 5/12 403/374.1
6,817,148 B1 * 11/2004 Sorkin ..... E04C 5/12 52/223.13
6,843,031 B1 * 1/2005 Sorkin ..... E04C 5/122 285/285.1
7,424,792 B1 * 9/2008 Sorkin ..... E04C 5/122 52/223.13
7,676,997 B1 * 3/2010 Sorkin ..... E04C 5/12 52/223.13
D615,219 S * 5/2010 Sorkin ..... D25/199
7,823,345 B1 * 11/2010 Sorkin ..... E04C 5/122 24/122.3
7,841,061 B1 * 11/2010 Sorkin ..... E04C 5/122 24/122.3
7,856,774 B1 * 12/2010 Sorkin ..... E04C 5/122 403/374.1
7,866,009 B1 * 1/2011 Sorkin ..... F16G 11/048 24/136 R
7,950,196 B1 * 5/2011 Sorkin ..... E04G 21/12 403/374.1
8,015,774 B1 * 9/2011 Sorkin ..... E04C 5/122 403/374.1
8,065,845 B1 * 11/2011 Sorkin ..... E04C 5/122 52/223.13
8,069,624 B1 * 12/2011 Sorkin ..... E04C 5/12 403/374.1
8,087,204 B1 * 1/2012 Sorkin ..... E04C 5/122 52/223.13
8,251,344 B1 * 8/2012 Sorkin ..... E04C 5/122 52/223.13
8,794,596 B2 * 8/2014 Kim ..... E04G 21/12 52/223.13
9,097,014 B1 * 8/2015 Sorkin ..... E04C 5/122
11,035,122 B1 * 6/2021 Sorkin ..... E04C 5/122
11,473,303 B2 * 10/2022 Sorkin ..... E04C 5/125
11,512,469 B2 * 11/2022 Sorkin ..... E04C 5/122
2003/0205014 A1 * 11/2003 Schneider ..... F16B 33/004 52/364
2006/0179742 A1 * 8/2006 Mathews ..... E04C 5/122 52/223.13
2017/0275881 A1 * 9/2017 Sorkin ..... E04C 5/12
2020/0299964 A1 * 9/2020 Sorkin ..... E04C 5/125
2023/0040105 A1 * 2/2023 Sorkin ..... E04C 5/125

* cited by examiner

MULTI-ANCHOR CONCRETE POST-TENSIONING SYSTEM

CROSS-REFERENCE TO RELATED APPLICATIONS

This application is a nonprovisional application which claims priority from U.S. provisional application No. 62/821,978, filed Mar. 21, 2019, which is incorporated by reference herein in its entirety.

TECHNICAL FIELD/FIELD OF THE DISCLOSURE

The present disclosure relates to a system and method used in post-tensioning concrete.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, roads, bridges, pavement, tanks, reservoirs, silos, foundations, sports courts, and other structures.

Prestressed concrete is structural concrete in which internal stresses are introduced to the concrete member to reduce potential tensile stresses in the concrete resulting from applied loads. Prestressing may be accomplished by post-tensioned prestressing or pre-tensioned prestressing. In post-tensioned prestressing, a post-tensioning tendon may provide a tension member that can be tensioned after the concrete has attained a specified strength. The post-tensioning tendon may include for example and without limitation, anchors, the tension member, and sheaths or ducts. A tension member could be any suitable material exhibiting tensile strength which can be elongated including, for example and without limitation, reinforcing steel, single or multi-strand cable. The tension member may be formed from a metal or composite.

A post-tensioning tendon typically includes an anchor at each end. The tension member is fixedly coupled to an anchor positioned at one end of the tension member, sometimes referred to as the "fixed" anchor, and is adapted to be stressed at a second anchor that is spaced-apart from the fixed-end anchor, sometimes referred to as the "stressing" or "live" anchor. The tension member is stressed by pulling the tension member through the stressing anchor; when the pulling force is released, the anchors grip the tension member and retain the tension member in tension. In some instances, the anchors grip the tension member using wedges, so that the gripping force increases when the tension on the tension member increases.

The concrete may be poured into a concrete form. The concrete form may be a form or mold into which concrete is poured or otherwise introduced to give shape to the concrete as it sets or hardens thus forming a concrete member.

In post-tension systems where the length of the desired concrete member is too long to pour as a single slab or too long to tension with a single anchor, the desired concrete member may be formed from multiple concrete sections and intermediate anchors may be employed. Each intermediate anchor may be attached to a concrete form that defines a concrete section. The concrete is stressed section by section. Intermediate anchors and associated systems may be employed whenever it is desired to form a concrete member from multiple, separately-stressed sections, such as when the desired concrete member is so long that a single live anchor (or stressing anchor) extending to a single dead end anchor (or fixed anchor) is inadequate.

In some cases, to allow access to the stressing-end of a post-tensioning tendon once the concrete is poured, a pocket former may be used to prevent or restrict concrete from filling the area between the stressing anchor and the concrete form used to form the concrete member. Once the concrete has sufficiently hardened and the concrete form is removed, the pocket former is removed from the concrete member. Traditionally, pocket formers are tapered (frustoconical). Tapered pocket formers may allow for easier removal from the concrete member. Typically, once the pocket former is removed and the post-tensioning tendon has been stressed by applying tension to the strand (cable), thereby forming a post-tensioned concrete member, the pocket formed by the pocket former is filled with a material such as a cementitious chloride-free grout or concrete to, for example, provide fire protection and corrosion protection. In the case of an intermediate anchor, the pocket may be filled with concrete when the subsequent (adjacent) section of concrete is poured.

The construction of a structure may include a series of steps, including, but not limited to, assembling a concrete form for one concrete section, pouring the concrete to form the concrete section, curing or hardening the concrete, and stressing the concrete section. One factor in the time required for the construction of the structure is the dependence of the completion of each concrete section on the completion of other concrete sections.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
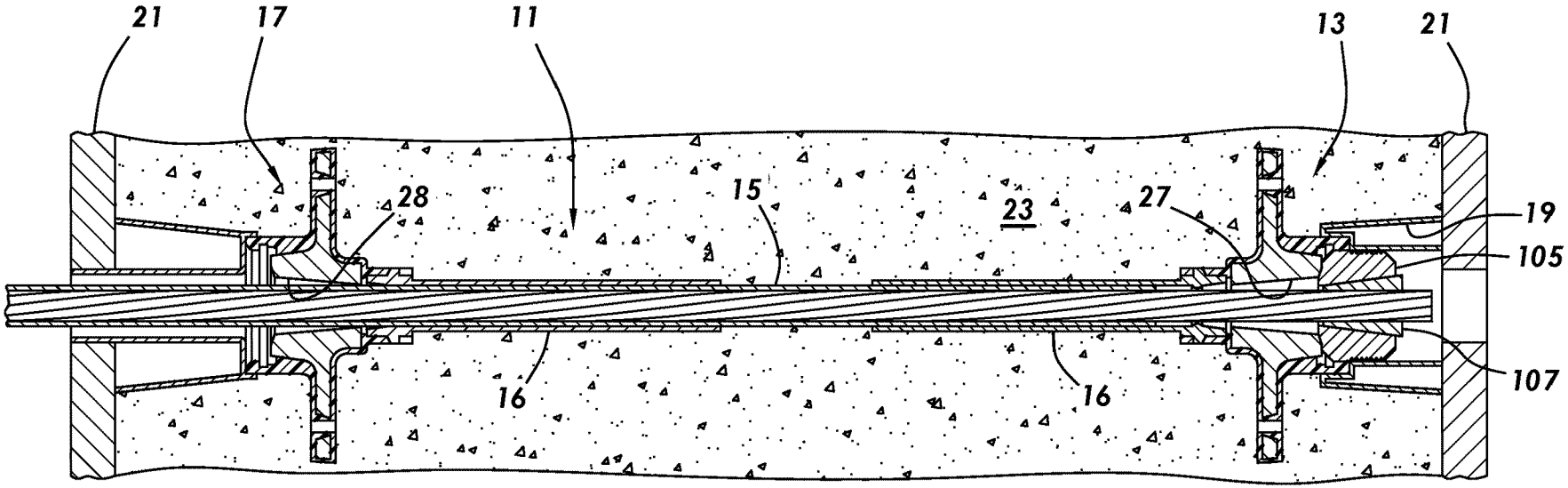
FIG. 1 is a cross section showing a step in a concrete pouring operation consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

When forming a concrete member to be post-tensioned, anchors may be provided to hold the tendon both before and after stressing.

Apparatus

In some embodiments, as depicted in FIG. 1, first post-tensioning tendon 11 may be positioned within first concrete form 21. First post-tensioning tendon 11 may include, for example, and without limitation, first anchor 13 positioned at a first position within first concrete form 21, first tension member 15, and second anchor 17 positioned at a second position within first concrete form 21. First tension member 15 may extend between and through first anchor 13 and second anchor 17. In some embodiments, first post-tensioning tendon 11 may also include a sheath positioned about first tension member 15 and one or more seals 16 between the sheath and each anchor, 13, 17. The sheath and seals 16 may, for example, protect first tension member 15 from corrosion after first concrete section 23 is poured. Additionally, the sheath and seals 16 may, for example, reduce or prevent concrete from ingressing into first tension member 15 and preventing or retarding its tensioning as discussed below. In some embodiments, seal 16 for first anchor 13 may be omitted. As used herein, "tension member" refers to any cable, strand, or the like that may be used to apply stress to a post-tensioned concrete form.

First and second anchors 13, 17 may each include a frustoconical passage, 27, 28, respectively, through which the tensioning member extends. Gripping wedges (not shown) may be positioned in frustoconical passages, 27, 28 so that first and second anchors 13, 17 may grip the tensioning member and maintain a tensioning force thereon, as is known. In some embodiments, first and second anchors 13, 17 may be positioned within first concrete form 21 such that first and second anchors 13, 17 will be at least partially encased in first concrete section 23 when form 21 is filled with concrete.

Figure 2:
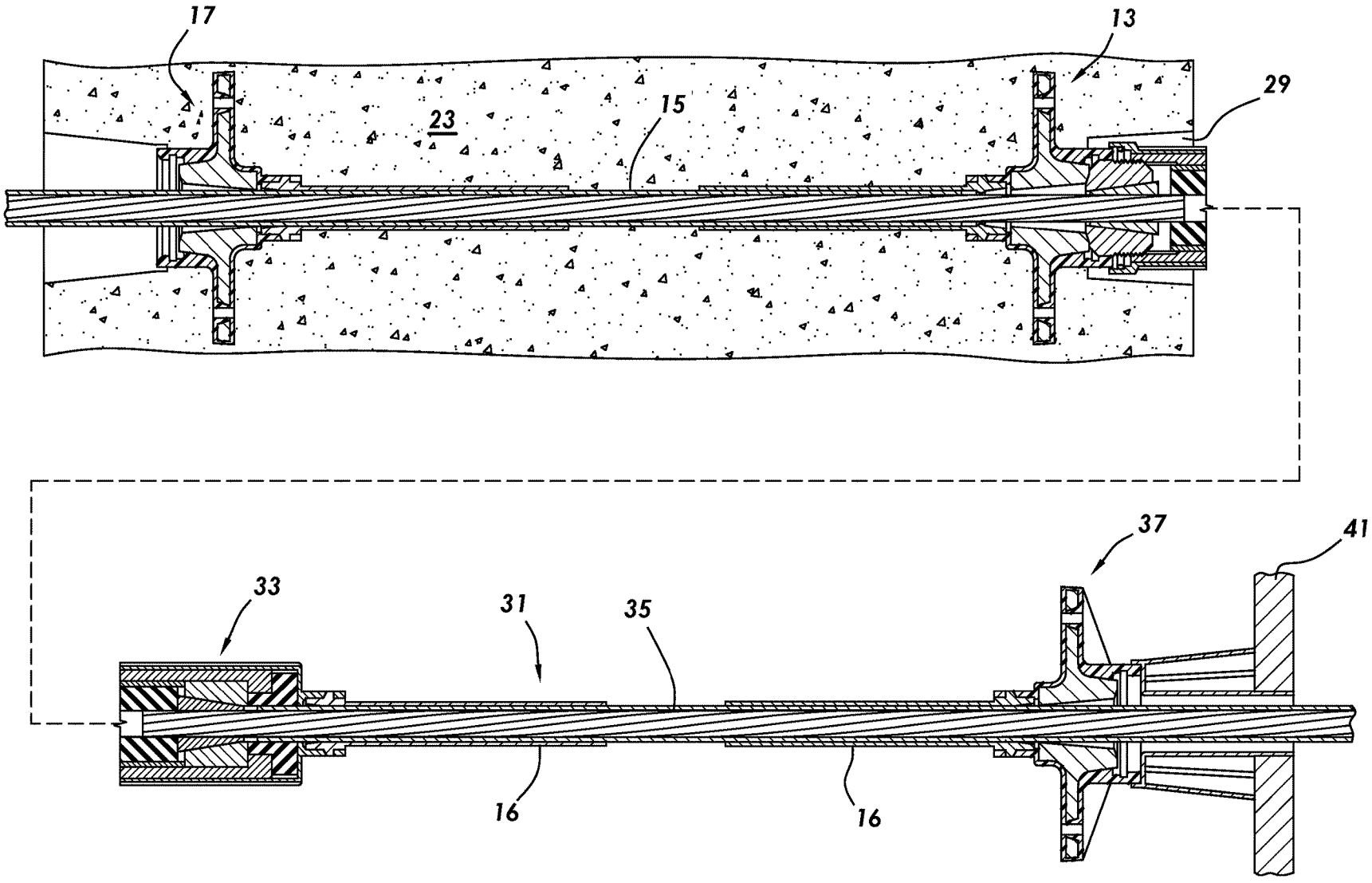
FIG. 2 is a cross section showing a further step in a concrete pouring operation consistent with at least one embodiment of the present disclosure.

In some embodiments, as depicted in FIG. 2, second post-tensioning tendon 31 may be assembled and positioned within a second concrete form 41 that is adjacent to first concrete section 23. Second post-tensioning tendon 31 may include, for example, and without limitation, coupler 33, second tension member 35, and a third anchor 37. Second tension member 35 may extend between coupler 33 and third anchor 37.

Second anchor 17 and third anchor 37 may each be stressing anchors configured for use with wedges, seals and/or pocket formers. Thus, second anchor 17 and third anchor 37 each allow the application of stressing force to a tension member extending therethrough. In some instances, such as when it is desired to include third or further concrete sections, third anchor 37 may function in the manner described below with respect to first anchor 13, i.e. third anchor 37 may be connected to a coupler and serve as a fixed anchor for an additional tendon.

As with first post-tensioning tendon 11, second post-tensioning tendon 31 may include a sheath positioned about second tension member 35 and one or more seals 16 between the sheath and each anchor. The sheath and seals may, for example, protect second tension member 35 from corrosion after second concrete section 25 is poured. Additionally, the sheath and seals may, for example, reduce or prevent concrete from ingressing into second tension member 35 and preventing or retarding its tensioning, as discussed below. In some embodiments, a seal for coupler 33 may be omitted. In some embodiments, coupler 33 may be positioned within second concrete form 41 such that coupler 33 will be encased in second concrete section 25, as described below.

Figure 3:
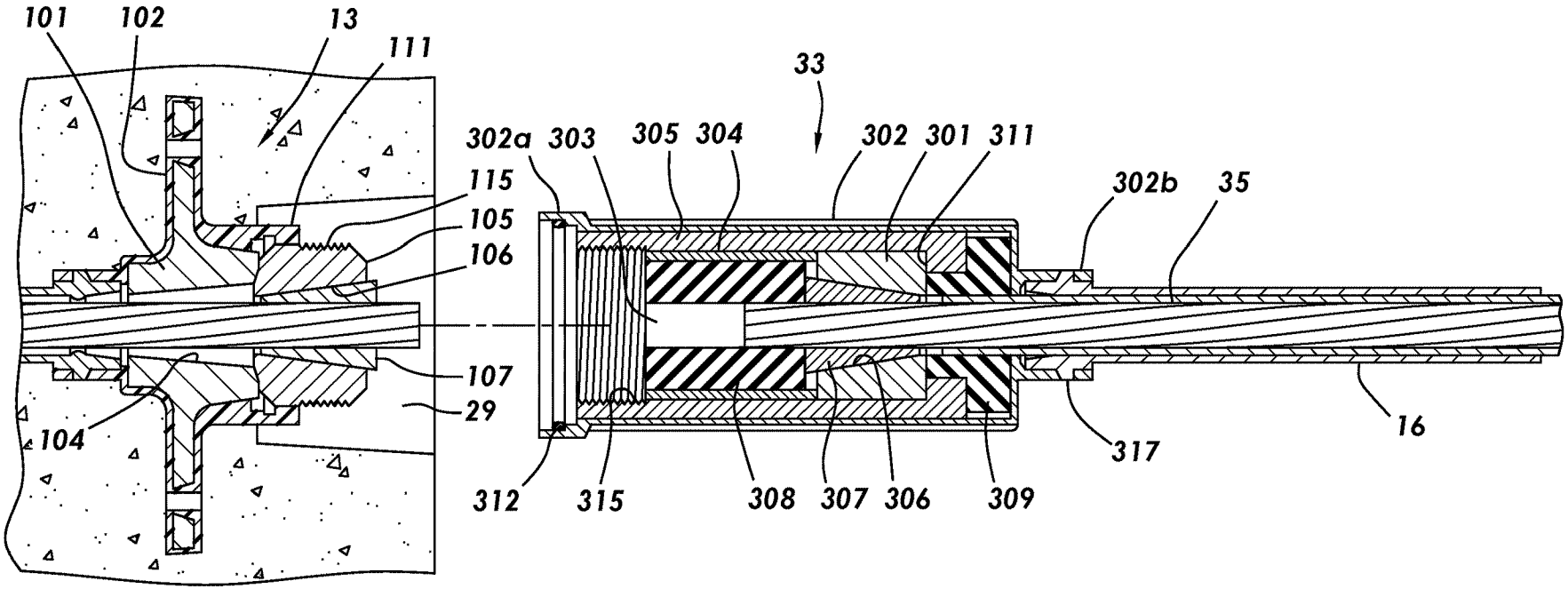
FIG. 3 is an exploded view of an anchor and a coupler consistent with at least one embodiment of the present disclosure.

Referring now to FIG. 3, in some embodiments, first anchor 13 may include first anchor body 101, which may be encapsulated in an encapsulating layer or cover, referred to as anchor encapsulation 102. Anchor encapsulation 102 may include lip 111 that extends longitudinally beyond first anchor body 101. Anchor encapsulation 102 may, for example, protect first anchor body 101 from corrosion after first concrete section 23 is poured. Additionally, anchor encapsulation 102 may, for example, reduce or prevent concrete from ingressing into first anchor body 101 and first tension member 15 and preventing or retarding tensioning. First anchor body 101 may be positionable within first concrete form 21 and coupleable to first tension member 15 so as to retain the position of first anchor body 101 within first concrete section 23 once first concrete section 23 sets. In some embodiments, first anchor body 101 may retain first anchor 13 in position under tension when positioned in first concrete section 23.

In some embodiments, first anchor body 101 may include a bore therethrough for receiving first tension member 15. In some embodiments, the bore through first anchor body 101 may also include a frustoconical passage 104. In some embodiments, a pocket-forming element such as pocket former 19 (FIG. 2) may be positioned between first anchor 13 and first concrete form 21 so as to create a pocket 29 (FIG. 3) in first concrete section 23 so as to allow access to first anchor 13 when first concrete form 21 and pocket former 19 are removed from first concrete section 23.

Still referring to FIG. 3, in some embodiments, an annular connector anchor 105 may be used in conjunction with first anchor 13. Connector anchor 105 may be mechanically coupled to first anchor body 101 by, including without limitation, a press-fit or threaded engagement with anchor encapsulation lip 111 or with first anchor body 101, or both. In some embodiments, connector anchor 105 is not mechanically coupled to first anchor body 101. Connector anchor 105 may include a bore therethrough and the bore may include a frustoconical portion 106 adapted to receive one or more wedges 107 therein. Connector anchor 105 may further include threads as described in further detail below. In some embodiments, connector anchor 105 or pocket former 19 may include a spacer, spring, or frictionally engaged member, for retaining wedges 107 in connector anchor 105 until a tensioning force applied to first tension member 15 is sufficient to retain wedges 107. In still other embodiments, connector anchor 105 is not connected to first anchor body 101 until after first concrete form 21 has been removed. In such instances, connector anchor 105 may be connected to coupler 33 before being placed into engagement with first anchor 13.

In some embodiments, one or more wedges can be provided in frustoconical passage 104 in first anchor body 101, either alternatively or in addition to wedges 107 in connector anchor 105.

Still referring to FIG. 3, in some embodiments, coupler 33 may include coupler body 301, coupler encapsulation 302, threaded connector 305, and first and second spacers 308, 309. Coupler 33 may include bore 303 therethrough for receiving second tension member 35. The bore through coupler body 301 may include frustoconical portion 306 adapted to receive one or more wedges 307. Connector 305 may be annular and may include an inner shoulder 311 on which coupler body 301 seats. In some embodiments, connector 305 may include threads 315 configured to engage corresponding mating threads 115 on connector anchor 105. In some embodiments, the threads 115 on connector anchor 105 are male threads and the threads 315 on connector 305 are female threads. In other embodiments, connector anchor 105 and connector 305 may be mechanically coupled by other suitable mechanisms, including but not limited to press-fit, bayonet connection, and set screws.

In some embodiments, coupler encapsulation 302 surrounds an outer surface of connector 305 and coupler encapsulation ends 302*a*, 302*b* are configured to sealingly engage anchor encapsulation lip 111 and seal 16, respectively. By way of example only, coupler encapsulation 302 may engage seal 16 by means of one or more locking tabs 317. Also by way of example, coupler encapsulation end 302*a* may engage an outer surface of anchor encapsulation lip 111 and may thereby mechanically couple coupler 302 to first anchor 13. In some embodiments, seal 312 may be included between coupler encapsulation end 302*a* and anchor encapsulation lip 111.

First and second spacers 308 and 309 may each be annular and may each comprise an elastomer, elastomer form, or crushable foam. Spacer 308 may frictionally engage the interior wall of connector 305; in some embodiments, spacer sleeve 304 may be included therebetween. Spacer 308 serves to retain wedge(s) 307 within coupler body 301 before a tension member is inserted therethrough. In instances in which connector anchor 105 is connected to coupler 33 before being placed into engagement with first anchor 13, spacer 308 may also serve to retain wedge(s) 107 in connector anchor 105. Spacer 309 may maintain coupler body 301 and connector 305 in a desired configuration within coupler 33 during handling and/or may enhance sealing between second tension member 35 and coupler 33 when installed.

Figure 4:
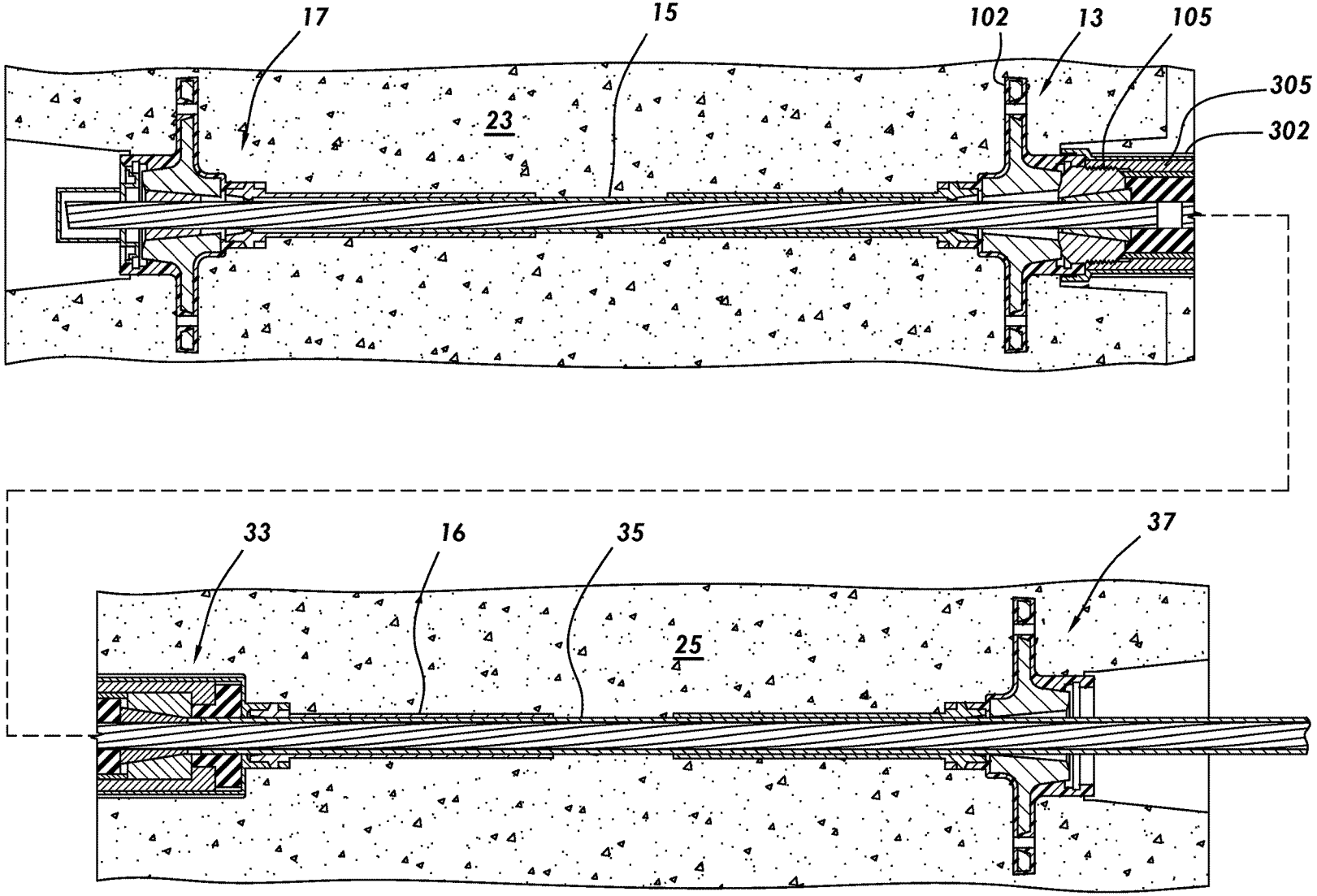
FIG. 4 is a cross section showing a still further step in a concrete pouring operation, consistent with at least one embodiment of the present disclosure.

Referring now to FIG. 4, coupler 33 is shown fully engaged with first anchor 13, whereby connector 305 threadedly engages connector anchor 105 and coupler encapsulation 302 sealingly engages anchor encapsulation 102 and seal 16. Coupler encapsulation 302 may, for example, protect coupler body 301 from corrosion after second concrete section 25 is poured. Additionally, coupler encapsulation 302 may, for example, reduce or prevent concrete from ingressing into coupler body 301 and second tension member 35 and preventing or retarding tensioning.

With coupler 33 and third anchor 37 in place and second tension member 35 extending therebetween and engaged thereby, concrete can be poured between first concrete section 23 and second concrete form 41 so as to form a second concrete section 25. Once second concrete section 25 has cured sufficiently, second tension member 35 can be used to post-tension second concrete section 25 at third anchor 37. If it is desired to include third or further concrete sections (not shown), third anchor 37 may function in the manner described above with respect to first anchor 13, i.e. third anchor 37 may be connected to a coupler and serve as a fixed anchor for an additional tendon (not shown).

Method

In operation and as depicted in FIG. 1, a first concrete section may be formed by constructing first concrete form 21, placing first and second anchors, 13, 17 therein, and pouring concrete into the form. Once first concrete form 21 has been removed and the concrete has cured or attained a predetermined hardness, the first concrete section can be tensioned by stressing first tension member 15 at second anchor 17. If a wedge was not already present in second anchor 17 one or more wedges may be inserted into second anchor 17 before the tensioning step. When a tensioning force is applied to first tension member 15, connector anchor bears on first anchor body 101. In this step, first anchor 13 functions as a fixed, or dead, anchor.

The use of coupler 33 allows construction of second concrete form 41 before first concrete form 21 is removed. By way of example only, the present system can be used to form a post-tensioned concrete member having at least one intermediate anchor and at least two adjacent concrete sections. Specifically, as shown in FIG. 2, coupler 33 may be coupled to first anchor 13 and a second tension member 35 may be extended between coupler 33 and third anchor 37. By way of illustration, in FIG. 2, first concrete section 23 has been poured but not post-tensioned and the form for second concrete section 25 has been assembled. Provided one end of first tension member 15 is engaged by wedge(s) 107 of connector anchor 105, it is not necessary to maintain access to first tension member 15 at first anchor 13, as first tension member 15 can be stressed at second anchor 17. Thus, coupler 33 can be placed into engagement with first anchor 13 before first concrete section 23 has been stressed. More specifically, connector 305 may be threaded into engagement with connector anchor 105. In this respect, the combination of first anchor 13 and coupler 33 acts as a second fixed anchor.

Coupler 33 can be applied to an end of second tension member 35 before coupler 33 is placed into engagement with first anchor 13. Alternatively, an end of second tension member 35 can be inserted into coupler 33 after coupler 33 is placed into engagement with first anchor 13. In some embodiments, first and second tension members can be provided as a single, long tension member, in which case coupler 33 would be threaded onto the tension member before placement of third anchor 37.

In some embodiments, connector anchor 105 may be connected to connector 305 before an end of first tension member 15 is inserted into connector anchor 105. In this instance, alternative, temporary means for retaining the end of first tension member 15 and maintaining access thereto may be desirable.

Provided one end of first tension member 15 is gripped by connector anchor 105, it is not necessary to maintain access to first tension member 15 at first anchor 13. Because the first concrete section can be post-tensioned from second anchor 17, access to first tension member 15 at first anchor 13 is not required and it is not necessary to wait for the first concrete section to cure before assembling second post-tensioning tendon 31 and pouring the second concrete section. In addition, because first anchor 13 serves as a fixed anchor, tension member 15 does not need to extend beyond first anchor 13 sufficiently to serve as the tension member for second concrete section 25.

Because connector anchor 105 can be retained to first anchor 13 by the action of wedges 107, connector anchor 105 can be used with any anchor and it is not necessary to provide a specialized interface or connection. Likewise, once connector anchor 105 is retained to first tension member 15 by the action of wedges 107, tensioning force can be transmitted from coupler body 301 to connector 305 and from connector 305 to first tension member 15 via connector anchor 105.

When first and second concrete sections 23, 25 each reach a predetermined cure point, each section can be post-tensioned at their respective stressing anchors. Specifically, first concrete section 23 can be post-tensioned by applying a tensioning force to an end of first tension member 15 extending from second anchor 17 and second concrete section 25 can be post-tensioned by applying a tensioning force to an end of second tension member 35 extending from third anchor 37.

First anchor 13 and coupler 33 combine to form an intermediate anchor that serves as a fixed anchor to both first and second post-tensioning tendons 11, 31. The connection of coupler 33 to first anchor 13 allows force to be transferred between first and second post-tensioning tendons 11, 31 even though the tension member is discontinuous (15, 35).

The wedges in each anchor grip the respective tension member in response to a tensioning force so as to retain it in tension. If desired, a portion of a tension member extending beyond a stressing anchor after tensioning can be removed and the remaining cable end may be capped or otherwise secured or enclosed.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

Further, it will be understood that, unless explicitly so recited, the sequential recitation of steps in the claims that follow is not intended to require that the steps be performed sequentially.

What is claimed:

1. A method for forming a concrete member comprising:

a) assembling a first concrete form having first and second ends;

b) assembling a first tendon for a first concrete section, the first tendon including a first anchor, a second anchor, and a first tension member affixed to the first anchor and the second anchor;

c) affixing a connector anchor to the first anchor;

d) affixing the first anchor to the first concrete form first end and affixing the second anchor to the first concrete form second end;

e) pouring concrete into the first concrete form so as to form a first concrete section in which the first anchor and the second anchor are embedded;

f) removing at least the first concrete form first end from the first concrete section;

g) assembling a second tendon for a second concrete section, the second tendon including a coupler, a third anchor, and a second tension member affixed to the coupler and the third anchor, the coupler including a coupler body and a connector, wherein the coupler body is disposed in the connector and the connector is mechanically coupled to the connector anchor, h) affixing the third anchor to a second concrete form; i) pouring concrete into the second concrete form so as to form a second concrete section which is adjacent to the first concrete section and in which the coupler and the third anchor are embedded;

j) stressing the first tendon at the first anchor; and k) stressing the second tendon at the third anchor; wherein step g) is carried out before step j).

2. The method of claim 1, wherein the first concrete section is cured before step k).

3. The method of claim 2, wherein step j) is performed before step k).

4. The method of claim 3, wherein step e) is performed prior to step j).

5. The method of claim 4, wherein the coupler is placed into engagement with the first anchor prior to step j).

6. The method of claim 5, wherein the connector is threaded into the connector anchor.

7. The method of claim 1, wherein the coupler is attached to the second tension member prior to being mechanically coupled to the connector anchor.

8. The method of claim 1, wherein the coupler is attached to the second tension member after the coupler is attached to the first anchor.

9. The method of claim 1, wherein the connector anchor is connected to the connector before the first tension member is inserted into the connector anchor.

10. The method of claim 1, wherein step g) is performed prior to curing the first concrete section.

* * * * *